United States Patent [19]

Cremona

[11] 4,323,101

[45] Apr. 6, 1982

[54] LOG SLICING PROCESS TO PRODUCE VENEER

[76] Inventor: Angelo Cremona, V.le Lombardia 275, Monza (Milano), Italy, 20052

[21] Appl. No.: 73,112

[22] Filed: Sep. 6, 1979

[30] Foreign Application Priority Data

May 16, 1979 [IT] Italy ..... 22692 A/79

[51] Int. Cl.[3] ..... B27L 5/00

[52] U.S. Cl. ..... 144/323; 144/177; 144/209 B

[58] Field of Search ..... 144/172, 178, 179, 209 R, 144/209 B, 209 C, 325, 323, 214, 162 R, 175

[56] References Cited

U.S. PATENT DOCUMENTS

| | | | |
|---|---|---|---|
| 16,308 | 12/1856 | Goodell | 144/177 |
| 144,938 | 11/1873 | Williams | 144/177 |
| 2,261,497 | 11/1941 | Hill | 144/209 B |
| 2,633,882 | 4/1953 | Menget | 144/214 |
| 4,013,108 | 3/1977 | Guillerm et al. | 144/162 R |

FOREIGN PATENT DOCUMENTS

| | | |
|---|---|---|
| 1711252 | 11/1955 | Fed. Rep. of Germany . |

*Primary Examiner*—W. D. Bray

*Attorney, Agent, or Firm*—McGlew and Tuttle

[57] ABSTRACT

A process for slicing logs to produce a veneer comprises passing a log to be sliced through a curved cutting path having a varying radius of curvature about a fixed axis and contacting the log with a cutting means for slicing a veneer therefrom.

5 Claims, 8 Drawing Figures

LOG SLICING PROCESS TO PRODUCE VENEER

FIELD AND BACKGROUND OF THE INVENTION

The invention relates in general to a process for cutting logs to produce thin sheets of wood and, more particularly, to a process for obtaining thin sheets of wood, used for decorative purposes, sliced according to a new and useful technique, which offers the possibility of obtaining, in relation to the different kinds and forms of timbers, the maximum qualitative and quantitative yield of a slicing operation.

It is well known that the demand for thin sheets of wood called "veneers" is continually increasing and is exceeding supply possibilities of actual forests which are offering logs smaller and smaller in size, therefore presenting more difficulties for their utilization in the veneer slicing industry (for example, oak and ash). Consequently, the essential problems connected with the production of such sliced veneers are becoming ever increasingly urgent and vital, and these problems can be summarized in the following paragraphs:

(a) maximum quantitative utilization of a log of wood, by using as much as possible of it for obtaining thin and good quality veneers, thereby minimizing waste and the parts which give poor quality veneers;

(b) for the same number of veneers of a given thickness, obtained from a given log, the obtaining of the greatest possible width with no detriment to the decorative quality;

(c) obtaining of the maximum number possible of veneers with optimum aspect, that is, with regular design, and with grain uniformly distributed at the two sides of the center line of the veneer and not excessively close or open.

Until now, it has not been possible with known means either to obtain the above three results simultaneously or has it been possible to obtain the third of them (subsection (c)) save only for a small part of the cut log. Until now, moreover, in order to obtain sliced sheets of wood for decorative purposes, two essentially different processes have been used based respectively on the two basic types of machines already known and used in this field.

The first, flat slicing process, uses veneer slicing machines in which the log and cutting tools are provided with straight-line reciprocating motion in a direction which can be, in accordance with the types, horizontal, vertical or inclined at any angle. With this process, flat veneers of constant and uniform thickness are obtained.

The record is an eccentric peeling process that uses a rotary veneer lathe in which the log turns about a fixed axis, eccentrically with respect to this axis, while the cutting tools are traversed radially towards the fixed axis of log rotation. With this process, curved veneers are obtained instead with constant and uniform thickness and with relatively marked curvature.

With the flat slicing process, good results are generally obtained for a small part of the log as regards the aspect of the veneers (see point (c)), but the results are modest with respect to the quantitative yield (see points (a) and (b)). In fact, with small size logs, "quartering" is not carried out because it would not be economical due to the heavy incidence on cutting times and the waste in cutting up and squaring up the blocks and for the trimming of the veneers. On the other hand, when the half log or indeed the entire log, is sliced, difficulties almost always occur when cutting close to the center or heartwood of the log, with poor results as regards the standard of finish and surface integrity of the veneer obtained. Consequently, the quantitative yield can drop down to about 50 percent and less; furthermore, veneers are obtained with average widths a good deal less than the log diameter, owing to the practical impossibility of slicing the widest part of the log in the vicinity of the center. This practical impossibility is derived from the physical constitution of many qualities of timber, oak being typical of these, which is, among other things, becoming increasingly more prized in the sliced veneer field. In these qualities of timber, the growth rings of the log are clearly marked and differ into two concentric parts, that of the spring growth being somewhat tender and yielding, and that of the summer growth being, in contrast, hard and fibrous; and, sometimes with the addition, as in the typical case of oak, of "medullary rays", that is, hard and compact fibres radiating from the centre of the log towards the edge. These characteristics bring about, as can be seen in more detail later on, difficulties in cutting which become greater and greater the larger is the angle $\alpha$ formed by the cutting direction with the tangent of the grain at the point of contact with the grain, more especially in the vicinity of the central zone of the log.

In the eccentric peeling process, which uses a rotary veneer lathe, optimum results are, instead, obtained as regards the quantitative yield (points (a) and (b)), which are, however, accompanied by poor results with respect to the surface finish (point (c)). In fact, the high curvature of cut of the veneers offers the advantage of appreciable increase of the average veneer width and the considerable reduction of angle $\alpha$ mentioned above. Furthermore, since the angle of intersection of the cutting paths increase with the medullar rays, it is possible to extend the slicing operation over the entire half log right up to the centre. On the other hand, however, as the cutting paths are almost tangential to the growth rings, excessive opening of the grain pattern occurs which appears on the surface of the sliced veneer.

SUMMARY OF THE INVENTION

It is an object of the process of this invention or minimize the difficulties and limitations of the two aforesaid processes hitherto known. It essentially includes of a slicing process involving a curved cut—with the possibility of varying the radius of curvature at will within a very wide range of variation during the actual slicing operation. This allows the selection, at each point of the log to be sliced, of the optimum radius of curvature and, therefore, the optimum cutting condition which surprisingly satisfy and optimize all of the above considered points, referring to the quantitative and qualitative yield of the slicing operation. In fact, as in the case of eccentric peeling, the log can also be sliced also close to the centre, thereby providing the possibility of defining a radius of curvature such as to sufficiently reduce the above mentioned angle $\alpha$. At the same time, it is possible to choose said radius of curvature so as not to open excessively the grain of the veneer design, and therefore to achieve the same standard of finish as obtained with flat slicing, or even to improve thereon, when the constitution of the log is such that the veneers cut in the vicinity of the log center would have, in flat slicing, excessively close grains at the edges with respect to those at the centre.

The preferred apparatus to achieve said process essentially consist of an attachment for supporting and clamping the log or part of it and an attachment holding the cutting tool and hold-down bar. The log supporting attachment must be able to rotate about a fixed axis and also have provision for radial travel with respect to said axis, both when it is rotating and when it is stationary.

The cutting tool holding attachment, instead, must be able to traverse radially with respect to the axis of rotation of the log supporting attachment.

Log rotation can, in turn, be either continuous or reciprocating like an oscillating pendulum. Likewise, the log travel and that of the tools can be both continuous (as the tool feed movement in standard rotary veneer lathes) and intermittent (as the tool feed movement in vertical flat veneer slicing machines, or of the log feed movement in horizontal flat veneer slicing machines), provided it be always synchronized with the rotary or pendular motion, so that for each complete revolution (or else for each complete pendular oscillation), the knife can detach a veneer from the log of the same thickness as that of the preceding veneer.

By suitably adjusting the log and tool traversing distances, it should therefore be possible to vary as required the distance between the knife cutting edge and the axis of rotation throughout the entire slicing operation, and consequently to vary the radius of curvature of the cut. By disengaging the log travel and only allowing that of the knife towards the log, a series of cuts will be obtained following concentric arcs of a circle, and of decreasing radius, starting from an initial radius which can be set as required within the maximum permissible value for the machine; hence veneers with increasing radius of curvature and with constant and uniform thickness are obtained. By disengaging, instead, the knife travel and allowing only that of the log towards the knife, slicing will be performed with a constant distance between the knife and the axis of log rotation, and therefore a series of cuts will be made following arcs of a circle of constant radius and with center being displaced each time, with respect to the log by a length equal to the feed per revolution of the log with respect to the axis of rotation; hence veneers are obtained with constant radius of curvature and with constant thickness, but not uniform over the entire veneer surface, as the thickness at the edges of the veneer tends to be less than that at the center, and this is in relation to the radius of cut and to the distance of the point considered by the radial straight line parallel to the direction of log travel. However, by suitably presetting the radius of cut in relation to log dimensions, it is possible, within given limits, to contain this lack of uniformity in thickness within acceptable values, or at any rate within the values permitted by current standards referring to thickness tolerances of sliced sheets of wood.

Lastly, by traversing both the log and the knife, as is the scope established by the Applicant, a series of cuts will be obtained following arcs of a circle with radius decreasing from an initial value to a final value which can be set as required within the maximum and minimum permissible values for the machine.

Accordingly, it is an object of the invention to provide a process for slicing logs to produce a veneer comprising passing a log to be sliced through a curved cutting path having a varying radius of curvature about a fixed axis and contacting the log with a cutting means for slicing a veneer therefrom.

In accordance with the invention the step of passing the log through a curved cutting path includes moving the log radially away from the axis or moving the cutting means radially toward the axis or both, simultaneously or intermittently. In accordance with a further feature of the inventive process, the log may be moved continuously radially away from the axis.

In accordance with still a further feature of the invention, a cutting means may be moved radially toward the axis continuously.

In accordance with still even a further feature of the inventive technique, the step of passing the log through a curved cutting path includes moving the log in a pendular oscillation about the axis. The log or cutting means or both may be moved radially away from the axis intermittently and synchronize with the step of passing the log through the curved path, particularly in synchronization with a pendular oscillation about the axis.

BRIEF DESCRIPTION OF THE DRAWINGS

The accompanying drawings, to be considered as an exemplication of the principles of the invention with no limitation intended, show.

DETAILED DESCRIPTION OF THE PREFERRED EMBODIMENTS

Figure 1:
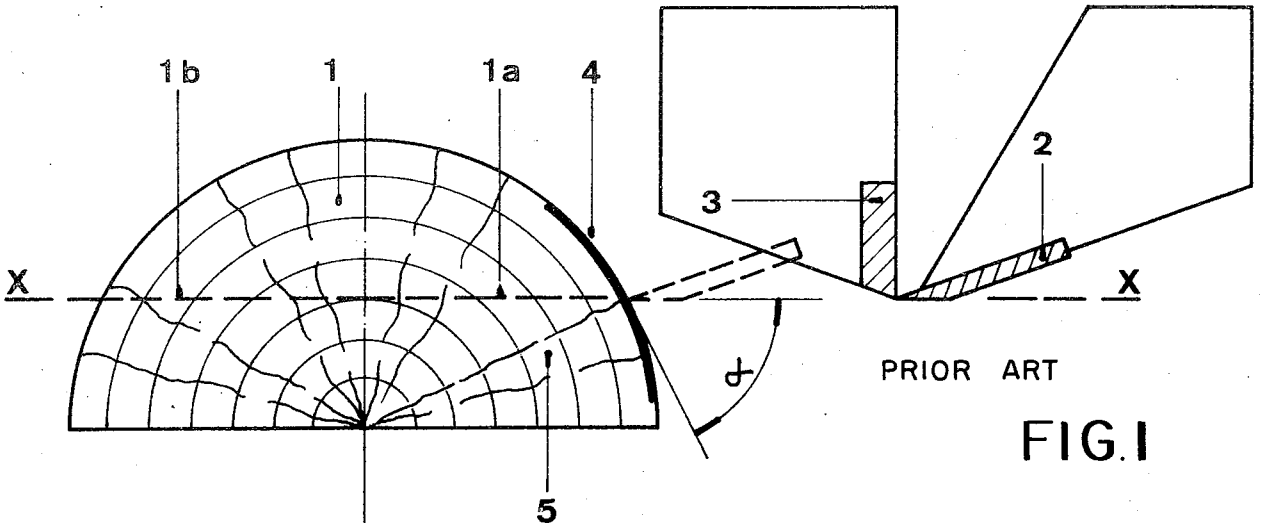
FIG. 1 PRIOR ART
in FIGS. 1 and 1*a*, a schematic representation of the already known flat veneer slicing process and corresponding view of the relative grain of a veneer produced thereby; and in FIGS. 2 and 2*a*, a schematic representation of the likewise already known process of eccentric peeling of a log half and a corresponding view of the relative grain of a veneer produced thereby, while FIGS. 3*a*, 3*b*, 3*c* schematically represent the process of this invention, that is to say, a process for slicing in curves with a radius R which is variable in the initial condition, in the intermediate condition and in the final condition respectively of the slicing operation
Figure 1A:
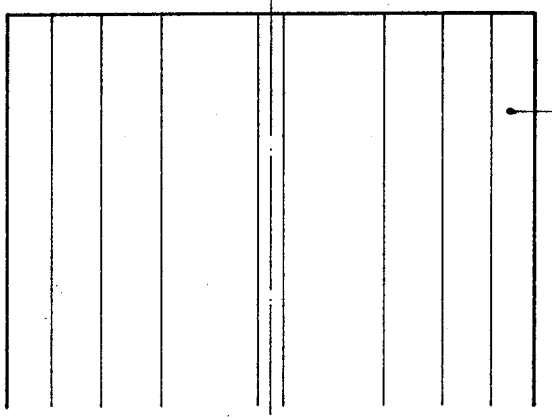
FIG. 1a PRIOR ART

As shown in the drawings, in the flat slicing process (FIG. 1) when log 1 is cut across its entire width by a tool assembly including a cutting blade knife 2 and a hold down bar 3. A cut is formed across the log having two clearly distinct successive zones along plane X—X. A zone 1-*a* corresponds to the first half of the cut surface and zone 1-*b* corresponding to the second half of the cutting surface. In zone 1*a*, when the cutting blade meets the hard part of the grain, that is growth ring 4, or else a medullar ray 5, a strong resistance to the cut occurs. The resistance is accompanied by a thrust component at right angles to the grain itself which compresses the more tender underlying layer of the grain 4, causing an elastic yielding as well as plus an appreciable deformation of the material in contact with cutting blade 2 before ripping of grain 4 or medullar ray 5 can occur. This does not occur in zone 1-*b*, because the component of the cutting force at right angles to the grain 4 is orientated towards the outside and is therefore opposed by hold-down bar 3. The above described negative effects relative to zone 1-*a* become increasingly more sensitive as the angle $\alpha$ which is formed between the plane of the cut and the tangent to grain 4 at the point of contact of the cutting blade with the log, increases. These effects become excessive and no longer tolerable for the utilization of the sliced veneer when $\alpha$ exceeds a certain limiting value (that is, from 60° to 70° in the case of oak logs) which is variable relative to the quality of the timber and to logs of the same quality in a more limited way, in relation to the machine cutting specifications. Moreover, close to the center of the log there are, with flat slicing, cutting paths which almost parallel the medullar rays, with the result that these leave bright flecks of open and irregular form (like the so-called "knit" patterns) which considerably reduce the decorative and commercial value of the veneer. The detail, indicated in FIG. 1, with refined numeral 6 represents the surface of the veneer corresponding to cutting line XX with the view of the relative grain.

Figure 2:
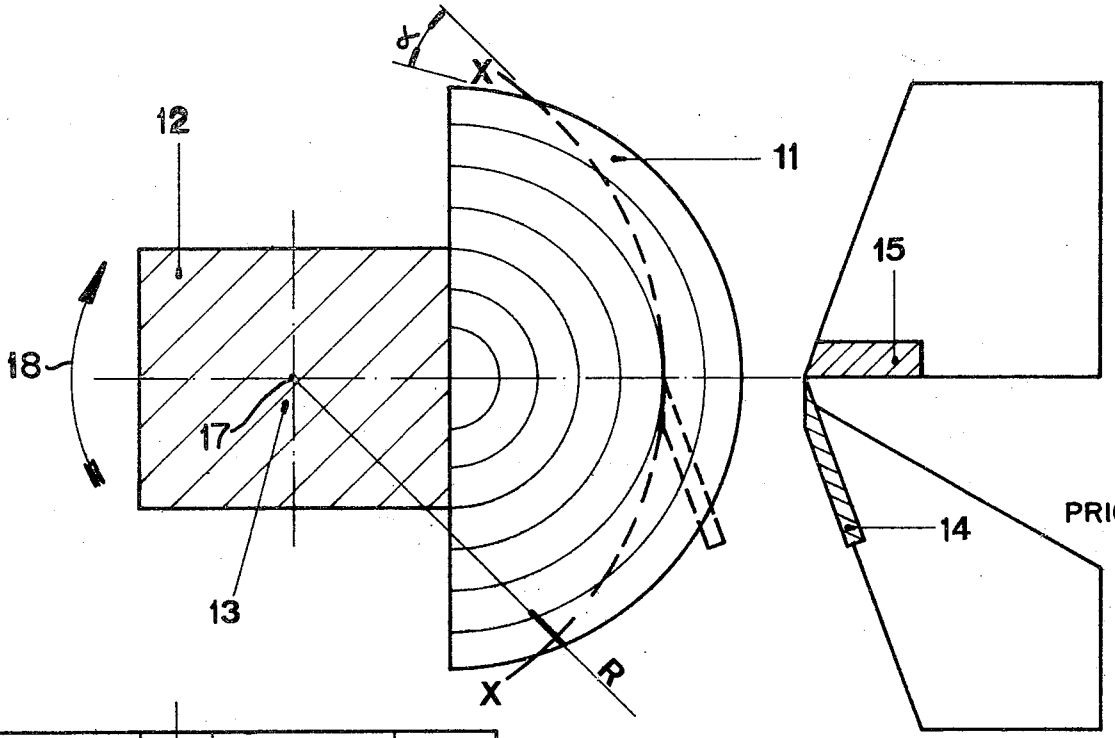
FIG. 2 PRIOR ART
Figure 2A:
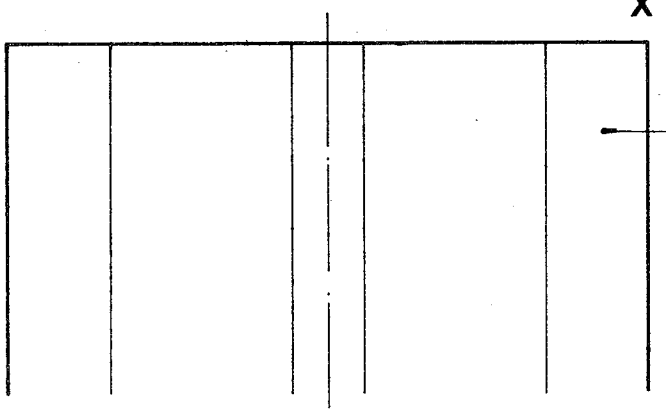

In the eccentric peeling process, instead—(FIG. 2) of a half log 11, clamped on beam 13, the latter rotates, as shown by arrow 18, about a fixed axis 17, while the tool assembly consisting of knife or cutting blade 14 and hold-down bar 15 traverses radially in the direction of arrow 19 towards axis 17. Detail 16 of FIG. 2*a* also represents here the surface of the veneer corresponding to cutting line XX with view of the relative grain.

Figure 3A:
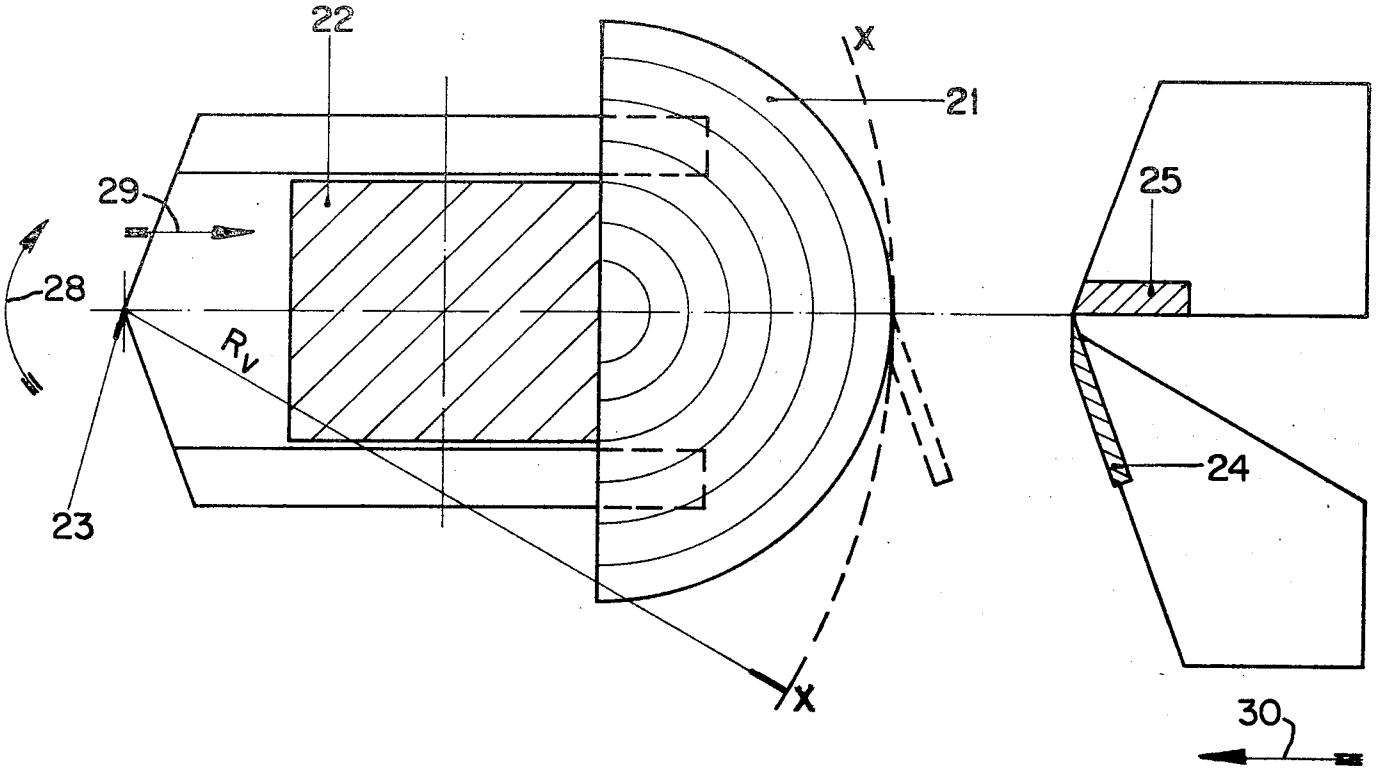
FIG. 3*d* shows a view of the relative grain of a veneer produced thereby.

Finally, in the curved slicing process with variable radius R according to invention (FIGS. 3*a*, 3*b*, 3*c*), a half log 21, clamped on beam 22 rotates about a fixed axis 23 as shown by arrow 28, and at the same time is radially traversed, as shown by arrow 29, towards the outside, that is towards a knife or cutting blade 24 while the tool assembly, consisting of said knife 24 and a hold-down bar 25, traverses, as shown by arrow 30, in turn also radially and in the reverse direction to the log 21 with respect to axis 23, that is, towards the latter.

Figures 3B, 3D:
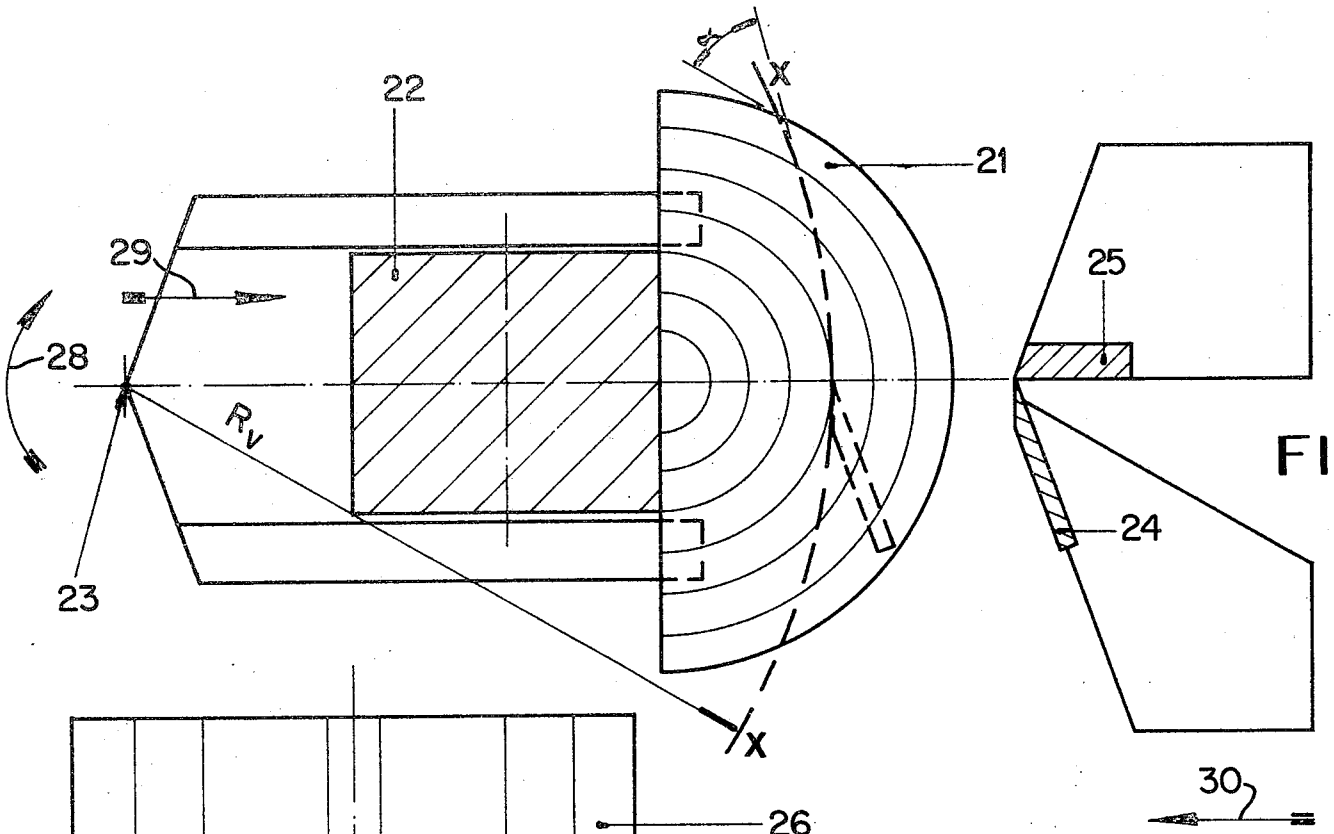
Figure 3C:
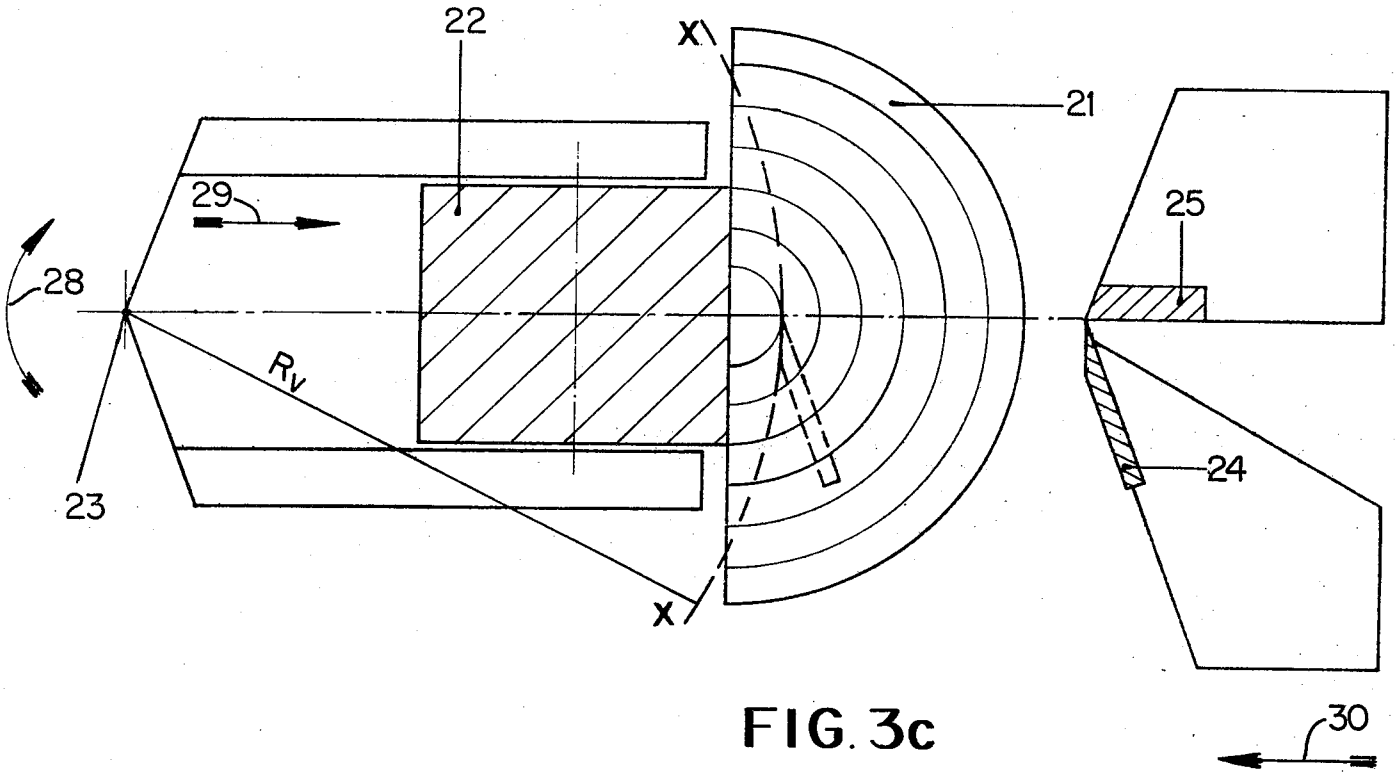

Also in FIG. 3*d* is shown detail 26 representing the surface of the veneer corresponding to cutting line XX with view of the relative grain, so that—by examining the drawings—the different results obtainable from the various processes can be compared and the appreciable improvement of the process of this invention will be quite clear.

Thus, in accordance with the invention, the inventive process for slicing logs to produce a veneer includes the steps of passing a log to be sliced through a curved cutting path having a varying radius of curvature about a fixed axis and contacting the log with a cutting means for slicing a veneer therefrom. In accordance with a preferred embodiment of the inventive technique, the step of passing the log through a curved cutting path includes moving the log radially away from the axis or moving the cutting means radially toward the axis or both, simultaneously or intermittently. In accordance with still a further preferred embodiment of the inventive process, the log may be moved continuously radially away from the axis. Moreover, the cutting means may be moved radially toward the axis continuously. In accordance with still a further feature of the invention, the radius of curvature of the cutting path varies in a continuous and preset fashion.

In accordance with still even a further feature of the inventive technique, the step of passing the log through a curved cutting path includes moving the log in a pendular oscillation about the axis. The log, or cutting means, or both, may be moved radially away from the axis intermittently and synchronized with the step of passing the log through the curved path, particularly in synchronization with a pendular oscillation about the axis.

I claim:

1. A process for slicing logs to produce a veneer comprising passing a log to be sliced through a curved cutting path about a fixed axis, varying the radius of curvature of said path about the fixed axis, contacting said log with a cutting means for slicing a veneer therefrom, wherein the step of passing said log through a curved cutting path includes moving said log radially away from said axis, moving said cutting means radially toward said axis, and wherein said steps of moving said log away from said axis and moving said cutting means radially toward said axis are performed simultaneously.

2. The process of claim 1 wherein said log is moved continuously radially away from said axis.

3. The process of claim 2 wherein said cutting means is moved radially toward said axis continuously.

4. The process of claim 1 wherein the step of passing said log through a curved cutting path includes moving said log in a pendular oscillation about said axis.

5. A process for slicing logs to produce a veneer comprising passing a log to be sliced through a curved cutting path about a fixed axis, varying the radius of curvature of said path about the fixed axis, contacting said log with a cutting means for slicing a veneer therefrom, wherein said radius of curvature of said cutting path varies in a continuous and preset fashion, wherein the step of passing said log through a curved cutting path includes moving said log radially away from said axis, moving said cutting means radially toward said axis, and wherein said steps of moving said log away from said axis and moving said cutting means radially toward said axis are performed simultaneously.

* * * * *